US005842449A

United States Patent [19]

Eisenmann

[11] Patent Number: 5,842,449

[45] Date of Patent: Dec. 1, 1998

[54] VALVE TRAIN WITH SUCTION-CONTROLLED RING GEAR/INTERNAL GEAR PUMP

[75] Inventor: Siegfried A. Eisenmann, Aulendorf, Germany

[73] Assignee: Hermann Harle, Aulesdorf, Germany

[21] Appl. No.: 969,055

[22] Filed: Nov. 12, 1997

Related U.S. Application Data

[62] Division of Ser. No. 544,074, Oct. 17, 1995, Pat. No. 5,738,501.

[30] Foreign Application Priority Data

Oct. 17, 1994 [DE] Germany ..... 44 37 076.8
Jun. 28, 1995 [DE] Germany ..... 195 23 533.9

[51] Int. Cl.[6] ..... F01L 1/34; F04C 15/04

[52] U.S. Cl. ..... 123/90.12; 123/90.17; 417/310

[58] Field of Search ..... 123/90.12, 90.13, 123/90.17, 90.18; 417/310

[56] References Cited

U.S. PATENT DOCUMENTS

| | | | |
|---|---|---|---|
| 2,509,321 | 5/1950 | Topanelian, Jr. | 60/436 |
| 3,272,128 | 9/1966 | Brundage | 417/440 |
| 4,106,446 | 8/1978 | Yamada et al. | 123/90.12 |
| 4,589,387 | 5/1986 | Miura et al. | 123/90.17 X |
| 5,096,397 | 3/1992 | Eisenmann | 418/171 |
| 5,247,914 | 9/1993 | Imai et al. | 123/90.17 |
| 5,380,169 | 1/1995 | Eisenmann | 417/284 |
| 5,413,470 | 5/1995 | Eisenmann | 418/171 |
| 5,547,349 | 8/1996 | Kimura et al. | 417/310 X |

FOREIGN PATENT DOCUMENTS

| | | | |
|---|---|---|---|
| 29 33 493 | 3/1981 | Germany . | |
| 3913414 | 10/1990 | Germany . | |
| 1-138394 | 5/1989 | Japan | 417/310 |
| 3-225092 | 10/1991 | Japan | 417/310 |
| 2-044356 | 10/1980 | United Kingdom | 417/310 |

*Primary Examiner*—Tony M. Argenbright
*Attorney, Agent, or Firm*—Ratner & Prestia

[57] ABSTRACT

The invention relates to a valve train of an internal combustion engine having hydraulic actuator for controlling a valve control device a function of engine speed and having a pump driven by the engine for supplying the actuator with working fluid. The pump is configured as a suction-controlled ring-gear pump having a sealing web ending over a plurality of pockets and featuring a delivery characteristic as a function of speed which is adapted to the working fluid requirement of said actuator. In addition, an internal gear pump is provided, particularly useful for such a valve train.

20 Claims, 10 Drawing Sheets

VALVE TRAIN WITH SUCTION-CONTROLLED RING GEAR/INTERNAL GEAR PUMP

This application is a division of application Ser. No. 08/544,074, filed Oct. 17, 1995, now U.S. Pat. No. 5,738, 501.

FIELD OF THE INVENTION

The invention relates to a valve train for an internal combustion engine having hydraulic actuator means for adjusting a valve control means as a function of engine speed and having a pump driven by the engine for supplying the actuating means with working fluids, and more particularly to a suction-controlled ring gear/internal gear pump having a housing, a gear chamber, a ring gear in the housing, a pinion arranged in the ring gear to mesh therewith, the pinion having at least one tooth less than the ring gear, the pinion and the ring gear together forming a sequence of pockets for the working fluid each sealed off from one another by meshing of the gears, at least one inlet passage and at least one outlet passage for the working fluid in the housing, wherein the working fluid is supplied from the inlet passage by at least one inlet port to the suction region of the gear chamber and is charged via at least one outlet port from the pressure region of the gear chamber into the outlet passage.

BACKGROUND OF THE INVENTION

In the course of the continuing development in automotive engineering the requirements on engine performance are increasing all the time. These engines are required to permit optimum control over a broad rotative speed range. To satisfy this requirement in both the lower and upper speed regimes of the engine, valve trains have been developed with which the overlap timing of the intake and exhaust valves may be varied as a function of the rotative speed. In systems for controlling the adjustment of valve overlap timing, known as so-called VTC (valve timing control) systems the camshafts for each of the intake valves and the exhaust valves are adjusted with respect to each other so that the cams of the two camshafts receive a shift in phase.

In addition to this camshaft control by turning the camshafts with respect to each other the valve strokes may also be varied, large valve strokes being adjusted with correspondingly longer overlap timing in the upper speed regime and smaller valve strokes being set with shorter overlap timing, or even none at all, in the lower speed regime of the engine. In addition, control of the valve stroke and/or the overlap timing from hot-running operation to normal operation is desirable.

A multiphase valve adjustment mechanism is known from page 342 of the German automotive magazine "Motortechnische Zeitschrift" 55 (1994) 6. The cam set of a six-cylinder engine used in this arrangement is provided with two rocker arms. Depending on the speed concerned, tee-jointed shafts (tee shafts) control simultaneously the two intake and exhaust valves per cylinder. At a high speed hydraulic pistons connect the two rocker arms to the tee shafts. At a low speed the tee shafts are connected to the arms for lower speeds. In addition, shutting off the cylinder is possible with this mechanism. For this purpose the tee shafts are disengaged from the rocker arms for the high speed so that only three of the six cylinders are working.

The usual pumps for engine oil delivery, for example vane pumps or common gear-type pumps deliver their working medium at a delivery pressure or flow which continually increases with the rotative speed of the pump. These pumps are usually driven directly by the engine via a corresponding ribbed belt drive or some other suitable gearing, so that delivery pressure or flow increase with engine speed. To enable the necessary valve train actions to be implemented already at low engine speeds, the usable pumps need to have in the lower speed regime of the engine a steep increase in their flow delivery. Accordingly, the known pumps are designed large with a correspondingly high power consumption, this being the reason why with increasing engine speed they deliver more engine oil than is required by the actuating means of the valve train, so that the excess needs to be returned directly from the pump output to a sump.

A pump designed as an internal gear pump is known e.g. from German Patent 39 33 978. The drive is made as a rule by the shaft carrying the pinion. The design delivery of such pumps, e.g. the lube pump of an automotive engine is roughly proportional to the speed only in the lower portion of the operating range. In the upper speed regime the lubricant or working fluid requirement increases far less than the speed of the engine, thus making a suction control of the pump necessary.

One drawback of such a suction control is the cavitation arising. The increase in pressure anticipated to be linear due to the increase in speed fails to be held in the pressure region of such pumps, instead the pressure increases non-linearly as of a certain speed with a lower increase. Once the full geometrical delivery flow in the working range fails to be achieved over the proportionality range, cavitation occurs which results in implosions of the gaseous constituents of the fluid pocket contents, so that nuisance noise and damage to the pocket walls are the result. In addition, such pumps exhibit in the higher speed ranges relatively poor efficiencies.

SUMMARY OF THE INVENTION

It is thus the object of the invention to create a valve train for a combustion engine in which actuating members for adjusting the control means for the valves of the engine may be supplied with the working fluid necessary for operating the actuating members in a manner which saves energy and is thus cost-effective. It is a further object of the present invention to provide an internal gear pump having minimum cavitation and high efficiency which may be put to use in particular for such an aforementioned valve train.

A valve train for an internal combustion engine is equipped according to the invention with a suction-controlled ring-gear pump having a sealing web comprising a plurality of pockets, the so-called pressure pockets, dimensioned increasing smaller from an inlet for the working fluid to a pump outlet. Such a pump used for the purposes of the invention has inherently a delivery characteristic as a function of the rotative speed which substantially corresponds to the requirement of the valve train. In its lower speed range such a pump exhibits a steep increase in the delivery to enable all consumers to be instantly supplied with sufficient oil. The delivery curve flattens off in the upper speed range or is essentially constant therein, corresponding to the actual requirement of a valve train, thus enabling the hydraulic dissipation loss to be reduced. By designing the pump suitably the expensive pressure control valves necessary in prior art may be eliminated. Simple safety valves are sufficient to protect especially sensitive consumers from overpressure when the engine is started cold. Due to the delivery being adpated to that required, not only are savings in hydrostatic power achieved but also fewer components in the pump delivery circuit are needed.

A suction-controlled ring-gear pump finds application to advantage as the delivery pump for camshaft control. Another preferred application is its use as a delivery pump for valve stroke control. Furthermore, such a pump may be put to use to advantage in shutting cylinders on and off, as is described for example on the aforementioned page 342 of the magazine "Motortechnische Zeitschrift" 55 (1994) 6. A combination of such types of valve train may be supplied just as much to advantage by such a suction-controlled ring-gear pump. When dimensioned accordingly the pump according to the invention in being employed for the purpose of valve control may additionally supply the engine with lubricating oil, the lubricating or engine oil also serving simultaneously as the working oil for the actuating means of the valve train.

Preferably the pump has throttling means at its suction end which are variable to enable the delivery characteristic to be adapted even better to the requirement of the consumers. Thus, a pump having a multi-stage delivery characteristic may be made available with a multi-stage throttling means, the number of these stages of the former corresponding to that of the latter. The throttling members concerned may be plain restrictors or throttles, but also regulating valves. An infinitely variable adjustment of the throttling means may also find advantageous application to enable pumps having large capacity to be flexibly adapted in situ to the differing requirements.

The decisive advantage of this novel internal gear pump according to the invention is that due to the regulated supply of working fluid from the outlet port into an inlet port with simultaneous interruption of the supply of working fluid from the inlet passage into said inlet port, a pocket in which with increasing speed a drop in pressure and thus cavitation would occur, is brought to the higher outlet pressure, thus resulting in cavitation being avoided in this pocket. Furthermore, a major advantage results in that, because no cavity, i.e. no negative pressure results in this pocket, it instead receiving positive pressure, this pressure produces a positive torque at the pinion. This pocket exposed to the higher pressure thus works like a hydraulic motor, enabling a very high efficiency to be achieved.

According to one preferred embodiment transit passages, spool and supply passages connect in sequence the bordering inlet ports to the pressure region with increasing pressure in the pressure region. As a result of this it is assured with increasing pressure that the pocket in each case, in which a drop in pressure and thus cavitation could take place, receives an early supply of pressure so that noise and damage can be avoided.

Preferably the means as stated above has a transit passage connecting the outlet port, the former porting via a valve device at least one supply channel which in turn connects an inlet port. The valve device is thus able to control the regulated supply of working fluid from the outlet port, i.e. the pressure region, into the inlet port and simultaneously throttle initially and later interrupt the supply of working fluid from the inlet passage into this inlet port. For this purpose such a valve device has preferably a spool which is biased by means of a spring supported in the housing against the pressure of the working fluid in the transit passage and which by means of a header sleeve blocks or releases access of the working fluid to the supply passages. By selecting its stiffness accordingly this spring offers the possibility of controlling the operating behaviour of the valve device, whilst the header sleeve of the spool may be configured in such a way that the pressurized working fluid presses against one of its surfaces, opposing the spring force, whilst by its side surfaces it blocks or releases the supply passages for the flow of working fluid depending on the position of the spool.

In the pressureless condition of the transit passage or up to a predetermined pressure therein, acting against the force of the spring by a stop on the housing, the spool may be held in a position in which no working fluid flows from the transit passage into a supply passage. This condition corresponds to the starting position of the valve means at low speed or when the pump is stationary. The opposite stop point of the spool may be dictated by holding the spool in the position in which working fluid flows from the transit passage into all supply passages, in its movement against the direction of the spring force, because the spring is at full tilt.

The inlet port for the pockets not to be connected to the transit passage is preferably limited in its size to roughly the region covered by these pockets, thus assuring that the pockets to be exposed with increasing speed to the pressure from the high-pressure space can be totally isolated from the suction space. Compared to this, the outlet port may cover roughly the total region of the pockets located, as viewed in the direction of delivery, downstream from the pockets which may be connected to the transit passage. Configuring the outlet port is this way is suitable because the pockets connected thereto are practically at high pressure throughout the complete operation.

In one preferred embodiment the end of the spool facing away from the header sleeve together with the housing forms a spring chamber which for damping the movement of the spool is filled with working fluid and is fluidly connected via a drilled passage to the working fluid in the inlet passage.

The valve device acts advantageously simultaneously as a safety valve in the form of bypass valve. Once the maximum pressure in the pressure region of the header sleeve has exceeded the last supply passage to such an extent that due to the resulting decompression a short-circuit flow of the working fluid from the pressure region into the inlet passage occurs, the spring delays full-tilt until an adequate discharge flow cross-section has been created.

In a further advantageous embodiment of the present invention the pinion of the internal gear pump has two teeth less than the ring gear and at the location of the teeth unmeshing a crescent-shaped filler fixed to the housing is provided. In this arrangement the teeth of the ring gear should be configured sufficiently pointed so that in the suction region the pockets are sealed off from each other via the meshing of the teeth.

In addition, the internal gear pump according to the invention may be characterized by the header sleeve of the spool comprising a sleeve base and a web of the same outer diameter adjoining the latter longitudinally, the guidance and sealing function of the spool in the bore of the housing being provided by the housing sleeves on the outer surfaces of the header sleeve base and the header sleeve web.

Advantageously an internal gear pump according to the invention may be employed as a suction-controlled pump for a valve train according to the instant invention.

The invention will now be explained in more detail with reference to the example embodiments shown in the drawing in which:

DESCRIPTION OF THE INVENTION

Figure 1:
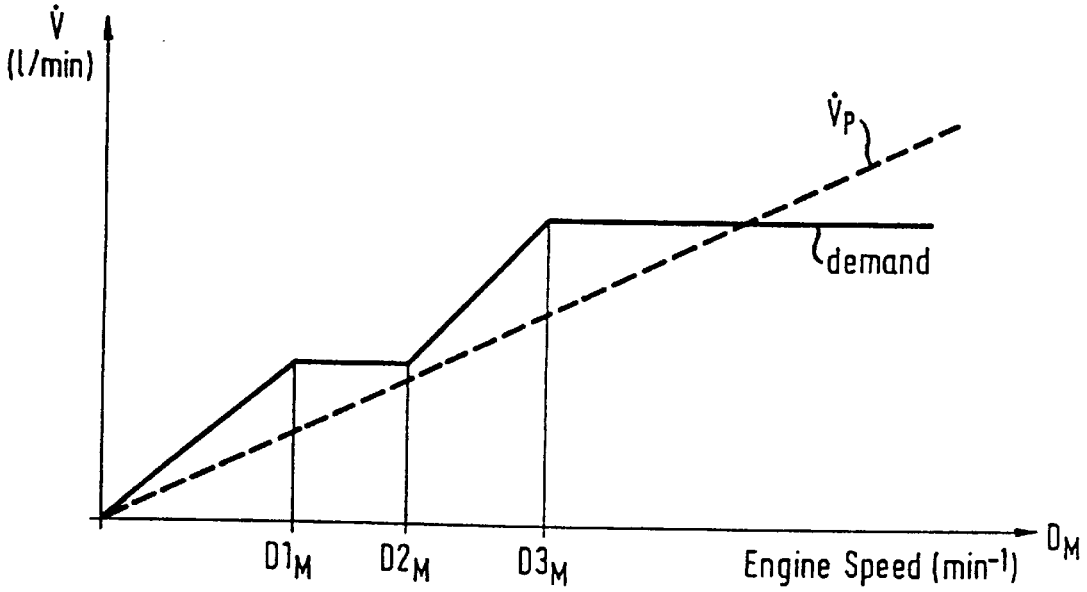
FIG. 1 is a graph showing the working oil requirement of a valve train.

In FIG. 1 a flow $V_P$ of a pump and a flow requirement of a valve train as a function of the engine speed $D_M$ are shown. The flow requirement of the valve train initially increases up to an engine speed $D1_M$, remains substantially constant in the subsequent speed range between $D1_M$ and $D2_M$, increases a second time from the speed $D2_M$ up to an engine speed $D3_M$ and then remaining substantially at the value attained at $D3_M$ with any further increase in engine speed.

Figure 2:
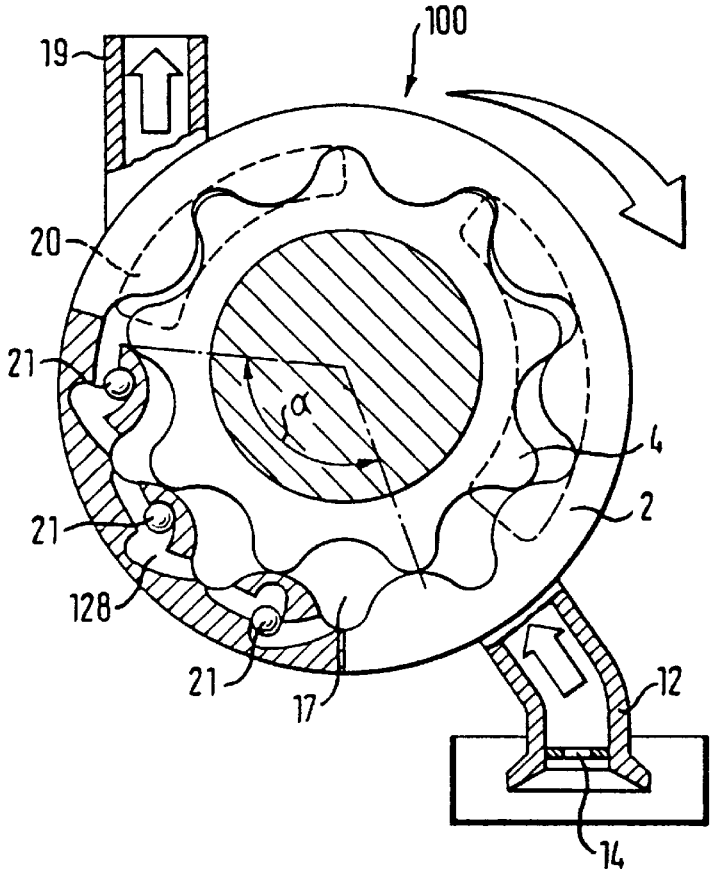
FIG. 2 illustrates a suction-controlled ring-gear pump having a restrictor in the inlet passage.
Figure 3:
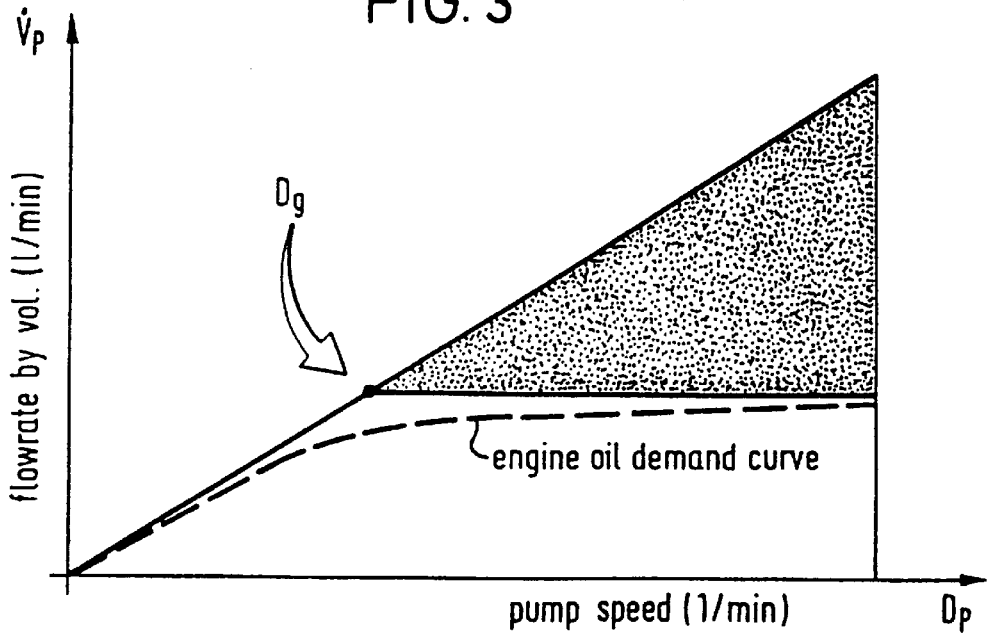
FIG. 3 is a graph showing the delivery characteristic of said suction-controlled ring-gear pump shown in FIG. 2.

FIG. 2 depicts a suction-controlled ring-gear pump 100 which due to the suction control already exhibits a delivery characteristic which is adapted to the flow requirement of a valve train. The delivery characteristic of the suction-controlled ring-gear pump as shown in FIG. 2, namely the flow $V_P$ as a function of the pump speed which may also be considered as being replaced by the pump delivery pressure, is shown in FIG. 3. According to this, the flow $V_P$ delivered by the pump flattens or tips off as of a limiting speed $D_G$ which can be established in design or also adjusted during operation, at the so-called point of down control, and subsequently remains more or less constant despite any further increase in the pump speed $D_P$.

By means of a restrictor 14 in the suction tube or inlet passage 12 of the pump 100 the flow of oil at the point of down control $D_g$ is limited. A critical flow rate materializes at the restrictor 14 and the intake and delivery oil flow remains more or less constant as of the point of down control despite any further increase in speed. Due to the throttling at the suction end a strong negative pressure materializes downstream of the restrictor 14 which is less than the vapor pressure of the oil. The oil begins to seethe and evaporate. On rotation of an internally toothed annulus 2 and a pinion 4 meshing therewith above the point of down control $D_g$ the tooth pockets 13 are filled with a mixture of oil and gas via an inlet porting the interior of the pump, the so-called suction kidney 11. On a conventional ring-gear pump the sealing land between the suction kidney 11 and a pump outlet, the so-called pressure kidney 20, is small. If such a pump were put to use, the tooth volume subject to a low pressure would suddenly be exposed to pressure. The "high-pressure oil" would penetrate into the "low-pressure region" and the gas bubbles would instantly change from the gaseous conidition into the fluid composite condition, i.e. they would implode. This phenomenon known by the term "cavitation" causes noise and damage to the pump. To prevent this, the suction-controlled ring-gear pump has a long sealing web between the suction kidney 11 and pressure kidney 20. This sealing web should cover an angle of at least 45°, preferably at least 90°. The oil/gas mixture is then gradually and not instantly compressed by the rotation of the pump at maximum tooth pocket volume and following the end of suction and with subsequent reduction in volume. In the pressure pockets 17 forming the sealing web the gas is able to pass through a controlled change in composite state and translate into the fluid state before the tooth pocket volume in the pressure kidney 20 is emptied.

In the lower pump speed range prior to the point of down control $D_g$ the tooth pockets 17 located along the sealing web between the suction kidney 11 and the pressure kidney 20 are filled 100% with oil. Assuming initially a maximum tooth pocket volume when the gear set 2, 4 rotates the suction kidney edge is intersected, isolating the tooth pocket volume and is pressurized due to a reduction in volume on further rotation. This is when the ball valves 21 start to function which are arranged in the outer annulus 2 in overflow passages 128 and act as check valves. Should the pressure in a tooth pocket 17 increase, the trailing valve 21 is closed with respect to the suction kidney 11 acting as the suction space, the advance valve 21 is opened with respect to the pressure kidney 20 acting as the pressure space. The oil flows via the resulting bypass into the next tooth pocket. Since here too, the pressure is increased on rotation, the oil flows into the then following tooth pocket, and so on, until it reaches the pressure kidney 20. It could be demonstrated by measurement that this pump produces no cavitation. Although the oil can form bubbles of gas, they fail to implode, but instead translate gradually and controlled into the fluid state. Accordingly, with a ring-gear pump throttled at its inlet end to a point of down control $D_g$ and configured as described above, the desired steep increase in the delivered flow of oil $V_P$ may be achieved at low pump speed, as shown in FIG. 3, when the pump is suitably dimensioned. Despite the oil/gas mixture forming with increasing pump speed $D_P$ in the sealing web between suction kidney 11 and pressure kidney 20, the power consumption of the pump remains relatively low for the then more or less constant flow $V_P$. When such a pump is employed in the supply circuit of a valve train little or no excess delivered oil at all needs to be directed into a sump. The employment of expensive pressure control valves may also be eliminated, inexpensive pressure limiting valves being necessary at the most. As compared to pumps used conventionally the power saving corresponds roughly to the flow triangle above the point of down control $D_g$, i.e. roughly the upper triangular area depicted dark in FIG. 3.

Figure 4:
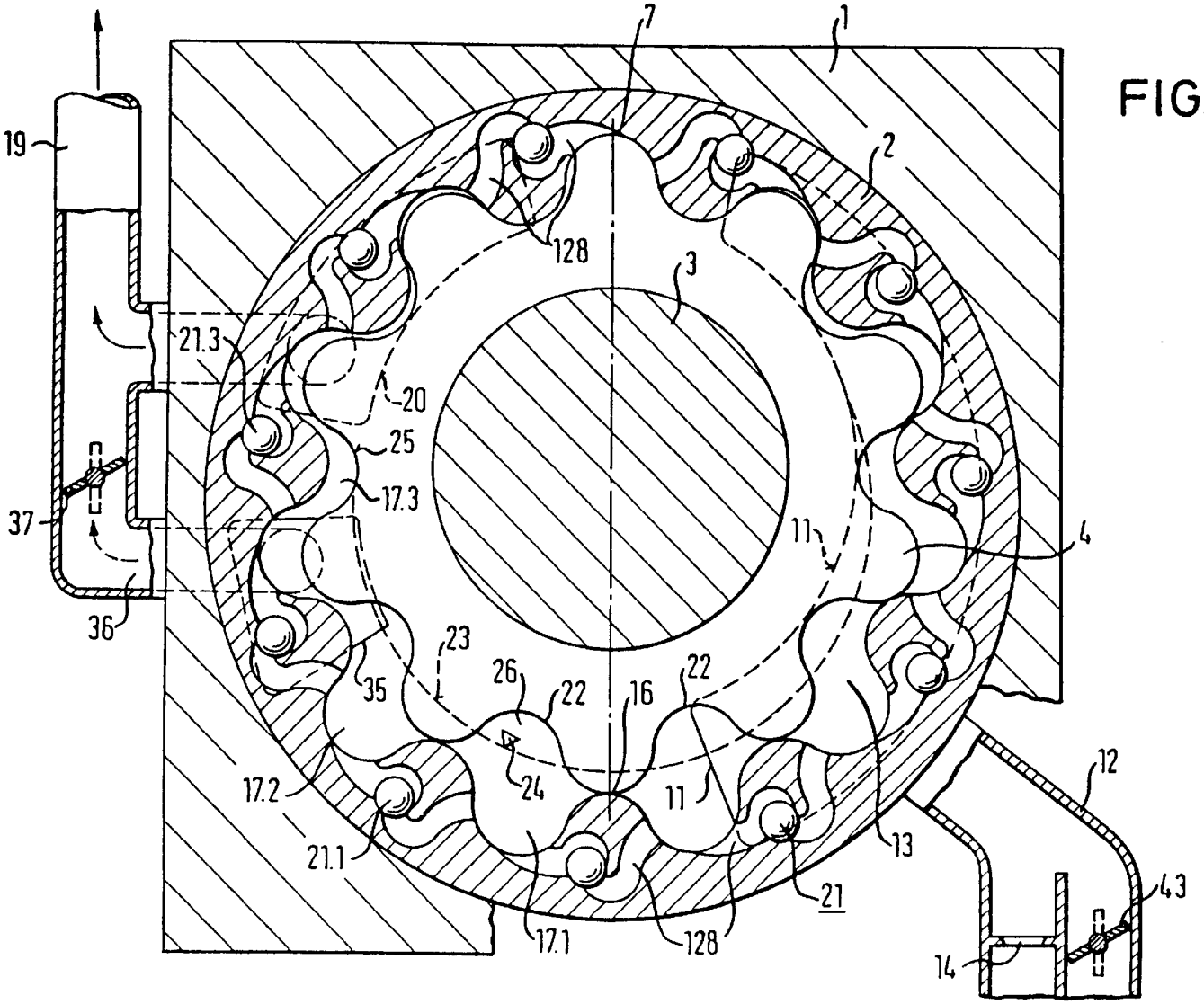
FIG. 4 shows a suction-controlled ring-gear pump in cross-section.

FIG. 4 shows a pump particularly suitable for the purposes of the invention, as is known from German Patent 42 09 143 C1. This pump has a pump housing 1, shown simplified, in the cylindrical gear chamber of which the annulus 2 is mounted with its circumference on the surrounding wall of the gear chamber. Also mounted in pump housing 1 is the pinion 4 of shaft 3 carrying the ring-gear pump; other mountings also being possible, however, to this extent.

The pinion 4 has one tooth less than those of the annulus 2 so that each tooth of the pinion 4 is always in mesh with one tooth of the annulus 2, resulting in all pockets formed by the tooth gaps of pinion and annulus being continually sealed off from the neighboring pockets. The pump rotates clockwise. The suction kidney 11 is provided in the gear chamber end wall located behind the plane of the drawing, the same applying correspondingly to the pressure kidney 20. The center-points of the two gears 2 and 4 are off-center which together with the Addendum circle diameters and the width of the teeth dictate the steepness of the delivery characteristic of the pump (FIG. 3).

At a low speed the suction velocity in suction tube 12 is small, so that the oil is able to flow free of bubbles into the suction kidney 11 arranged in the side of the housing 1 and extending practically over the full suction circumferential region, due to no substantial negative pressure occuring. Since at a low speed and tooth frequency the impedance to the flow between tooth and tooth gap is small, the suction pockets 13 formed by the teeth of the gears 2 and 4 of the suction end are filled with oil which is substantially free of bubbles. The suction kidney 11 serving to port the suction tube extends in the circumferential direction of the gears 2 and 4 up to the vicinity of a point 16 of minimum tooth mesh. In the region of this point 16 the pockets 13 formed by two each tooth gaps opposing each other have achieved their maximum volume and are totally filled with oil at a low speed. With further rotation of the pump the pockets attain the region to the left of point 16 where the pockets in the positions 17.1, 17.2 and 17.3 become displacement pockets, due to the volume of the pockets from here on up to the position of deepest mesh 7, diametrally opposed to the point of minimum mesh 16, being continuously reduced to almost zero.

On ring-gear pumps having no suction control the pressure kidney 20 serving as the outlet orifice may extend up to the vicinity of point 16, the pressure kidney 20 and thus also the pocket then being exposed to full delivery pressure in the first position 17.1.

Contrary to this arrangement the pressure kidney 20 of the gear chamber in the present pump is shortened in the cirumferential direction towards the point of deepest mesh so that a plurality of pockets 17.1 thru 17.3 are located between the suction kidney 11 and the pressure kidney 20. In the example embodiment the sealing web covers an angle of more than 90°, the pockets 17.1 thru 17.3 needing to be able to empty themselves when filled with oil free of bubbles. This is permitted by the overflow passages 128 in the teeth of the annulus 2. Each overflow passage 128 is provided with a check valve 21. The pockets 17.1 thru 17.3 in which the volume of the compressed medium is continually reduced are able to empty themselves in the direction of delivery to pressure kidney 20 by means of the series arrangement of overflow passages 128 along with the check valves 21.1 thru 21.3 arranged therein. In this arrangement it is then necessary that a static pressure exists in the pockets 17.1 thru 17.3 which is somewhat higher than that in the pressure kidney 20, since the overflow passages 128 together with the check valves 21 inherently result in losses due to the flow impedance. At a low speed these losses are not high, since the flow velocities are small. The throttling losses should be maintained as small as possible by a suitable design of the check valves.

Up to a certain limiting speed $D_g$ (FIG. 3) delivery is roughly proportional to the speed. Once this limiting speed Dg is exceeded the static pressure in the suction tube 12 begins to fall, it dropping below a critical value. On the pump tested according to the example embodiment this limiting speed Dg is roughly 1,200 rpm. As of roughly 1,500 rpm the delivery stagnates despite increasing speed, due to the static suction pressure having dropped below the evaporation pressure of the working oil. From then on cavities materialize in the pockets at the suction end of the pump which are concentrated theoretically in the region of the Dedendum circle of the pinion 4, i.e. at 22, since the oil free of bubbles is displaced by centrifugal force radially outwards. At roughly 2,100 rpm the pump delivers only roughly two-thirds of maximum displacement capacity. This condition is depicted by a dashed level line 23 as a circle concentric to the center-point of the annulus. This level line 23 is identified by the level numeral 24. Radially within the level line 23 substantially oil vapor and/or air is located, oil being substantially located radially without. This level line 23 passes through the Dedendum 25 of the pinion tooth gap of the pocket 17.3 which is just about to enter into contact with the pressure kidney 20. The pump is advantageously designed so that even at the maximum operating speeds to be anticipated, the level line 23 has not wandered substantially further radially outwards than up to the Dedendum 25 of the pinion tooth gap of the pocket 17.3 which is just about to start attaining the edge of the pressure kidney 20. This level line 23 may of course always lie radially further inwards as long as the suction control does not suffer.

Since pockets 17.1 thru 17.3 are sealed off from each other by tooth tip and flank meshing and in the design shown the check valves 21 are closed not only by the centrifugal force acting on the valve ball, on the one hand, but also by static pressure increasing from pocket 17.1 via 17.2 up to 17.3, on the other, the delivery pressure in the pressure kidney 20 is unable to be effective in the pockets 17.1 thru 17.3. The cavities within the level ring area 23 thus have sufficient time to become depleted before reaching pocket 17.3 due to the reduction in volume.

To displace the limiting speed Dg upwards, a bypass is provided in the suction tube 12 in parallel with the restrictor 14, a further throttle, namely a throttle 43 being arranged in said bypass which permits adjustment between the positions "open" and "closed".

The pump configured as such with the restrictor 14 and the throttle arranged in parallel thereto is already adapted to the requirement curve of the valve train as shown in FIG. 1, it merely being required that the throttle 43 changes from its "closed" position to its "open" position at the engine speed $D2_M$ as entered in FIG. 3.

Furthermore, the discharge passage 19 of the pressure kidney 20 is supplied not only by the pressure kidney 20 but also by a further outlet opening 35 located upstream of this pressure kidney 20, the former being connected via a passage 36 to the outlet passage 19 in the manner as evident from FIG. 4. In passage 36 a throttle 37 is also provided which is adjustable or switchable between one position shutting off passage 36 and the other opening the flow through passage 36.

In the normal operating status the two throttles 43 and 37 are closed. Should largish quantities of oil be necessary, because of an actuator means 76 or 82 being included in circuit, a corresponding control means opens the two throttles 43 and 37. This, for one thing, reduces the suction impedance strongly and shifts the level line 23 correspondingly outwards. In FIG. 2 the limiting speed Dg of the delivery characteristic along the slanting line upwards. Opening of throttle 43 is coupled to the pump speed and thus to the engine speed via a suitable control electronic circuit so that throttle 43 is opened, for example, when the engine speed $D2_M$ entered in FIG. 3 is attained.

Due to throttle 37 also being switched over along with switching over of throttle 43, the now greater amount of oil must not be additionally transferred through the overflow passages 128 forwards to the forward end of the pressure kidney 20. Instead, due to the advanced outlet opening 35 and the passage 36, the functionally deciding edge of the pressure kidney 20 is now nearer to the point 16 of minimum mesh. In this way throttling losses in the overflow passages 128 are minimized. The efficiency of the pump is elevated and the delivery increases more or less linearly, until the speed of the engine has attained the new, higher limiting speed.

Other throttling arrangements in the suction tube 12 are possible. For instance, with elimination of a bypass, the arrangement of a single throttle adjustable in steps or continuously can be put to use also to advantage. Also, a control valve may be provided. Throttling the suction tube 12—and also the outlet passages 19, 36—is controlled as a function of engine speed, on which also the working oil requirement of the valve train of the engine depends. By corresponding throttling arrangements the suction-controlled ring-gear pump may thus be adapted to the most varied of requirement levels.

Figure 5:
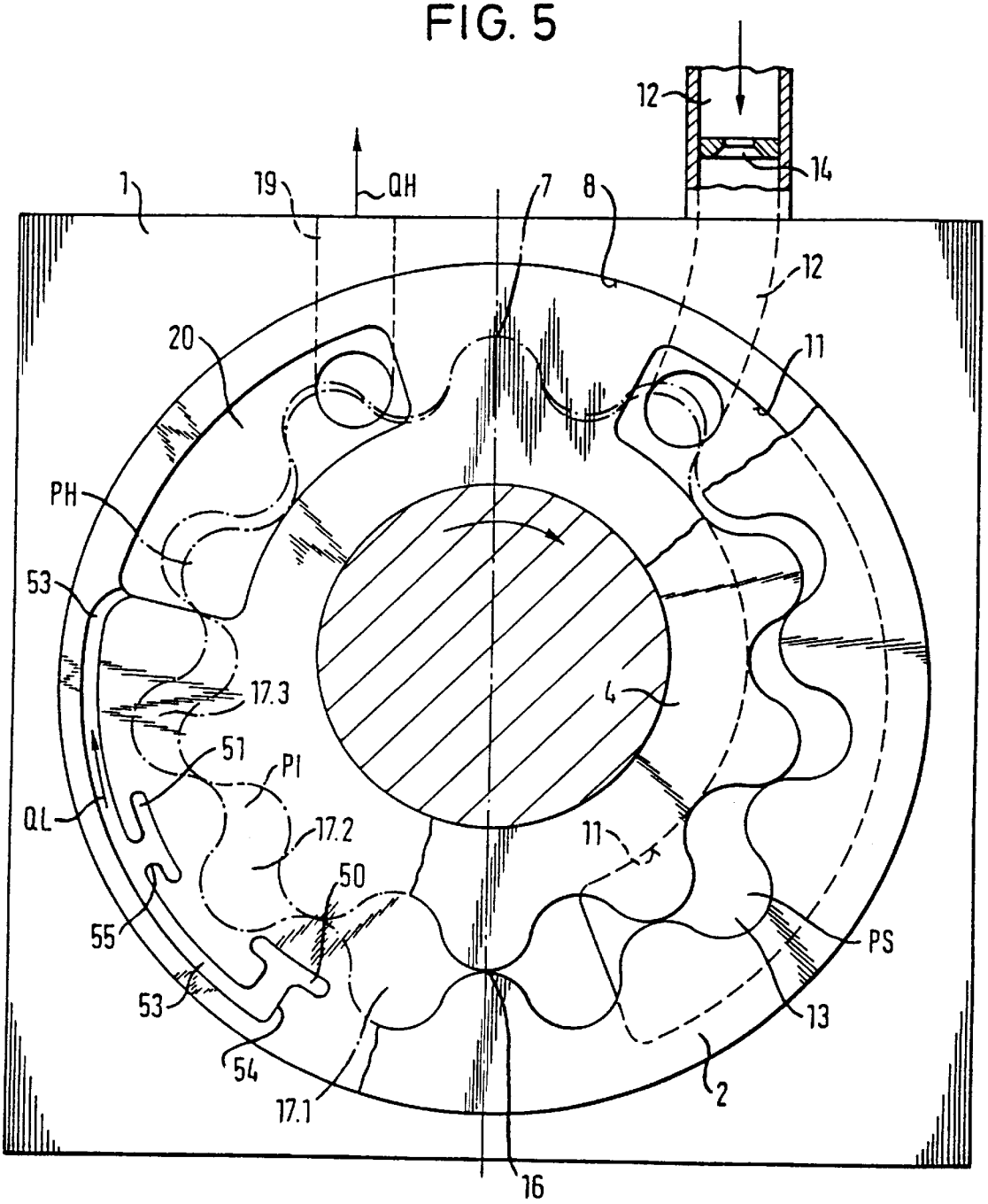
FIG. 5 shows a further suction-controlled ring-gear pump in cross-section.

In addition to the overflow passages 128 provided with check valves 21 an additional bypass may be disposed in an end wall of the gear chamber in the path of the pockets 17.1 thru 17.3, i.e. in the vicinity of the Dedendum circle of the annulus 2, this bypass extending circumferentially to the forward edge of the pressure kidney 20. The configuration of one such bypass is known from the German patent application 43 30 586.5 and is depicted in FIG. 5.

In accordance with the relative large number of teeth this bypass is formed by openings configured in the end wall of the gear chamber, two such openings 50 and 51 being involved in the example embodiment, and a connecting passage 52 also configured in the end wall. The openings 50 and 51 are located in the vicinity of the Dedendum circle of the toothing of the annulus 2 within said Dedendum circle. Each of the two openings 50 and 51 is connected via a short passageway 54 and 55 respectively oriented radially outwards to the connecting passage 53 oriented circumferentially which is connected to the pressure kidney 20. The radial passageways, the openings 50, 51 and the connecting passage 53 are formed as grooves in the end wall of the gear chamber. They may have a rectangular cross-section with rounded corners, for example, their depth being roughly equal to the width of the groove as shown. The connecting passage 53 is continuously covered by the ring section of the annulus 2 which carries the teeth. Since shortly having departed from the point 16 of tooth crest contact the pockets still gradually become reduced, the end facing the point 16 of the first opening 50 may have a relatively large angular spacing from this point circumferentially, which in this case is roughly equal to two-thirds of the tooth pitch measured angularly of the rim gear covering this opening 50. As compared to this, the end of the opening 51 located in the direction of delivery is spaced substantially further away from the forward edge of the pressure kidney 20, namely slightly more than one tooth pitch, so that every time a pocket loses contact with the opening 51, it soon begins to open into the pressure kidney 20. The spacing of the ends of the two openings 50 and 51 facing each other is so large that the two openings 50 and 51 are never connected by a pocket; it may even be somewhat greater if the openings are narrow.

In configuring the openings 50 and 51 the radial position of these openings also needs to be taken into account. For instance, to obtain equal opening and closing times, the extent of the openings 50, 51 circumferentially needs to be all the smaller, the more further away the openings are spaced from the Dedendum circle of the annulus 2. To signify this the opening 50 is arranged somewhat further radially inwards than the opening 51, it then extending, however, somewhat less long circumferentially. Both openings 50 and 51 are relatively short in the example embodiment, in many case they even being configured somewhat longer.

Figure 6:
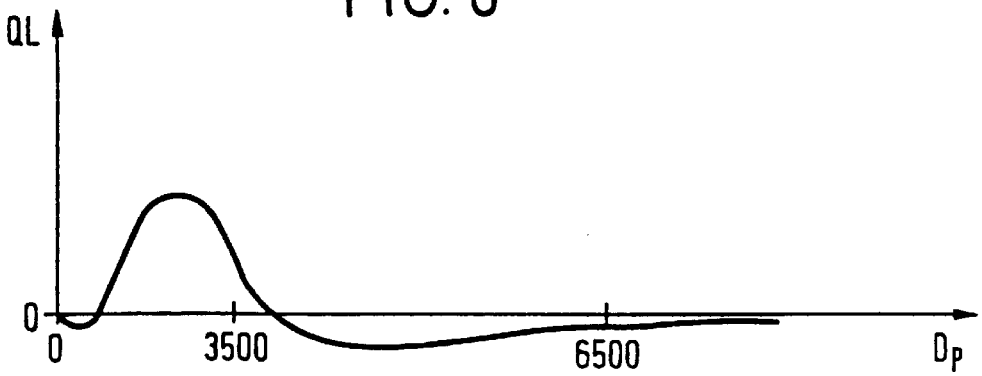
FIG. 6 is a graph showing the leakage oil flow as a function of the speed N for the pump as shown in FIG. 5.
Figure 7:
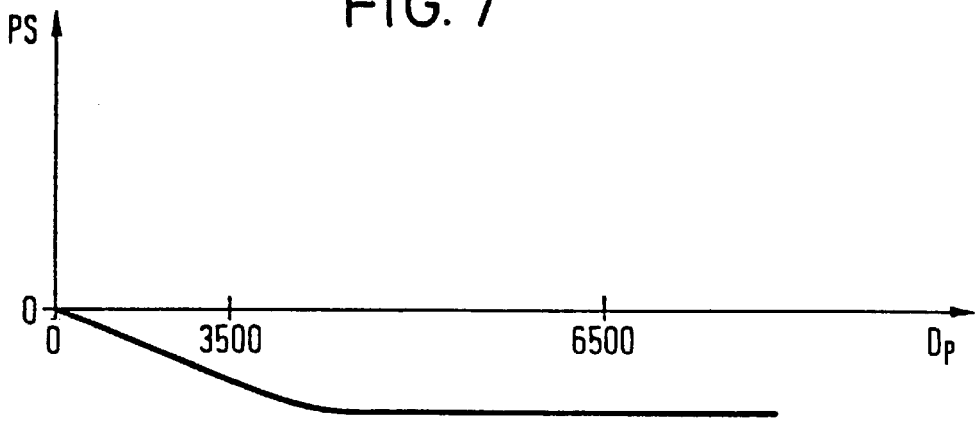
FIG. 7 is a graph showing the suction pressure at the inlet of the pump as shown in FIG. 5 as a function of pump speed.
Figure 8:
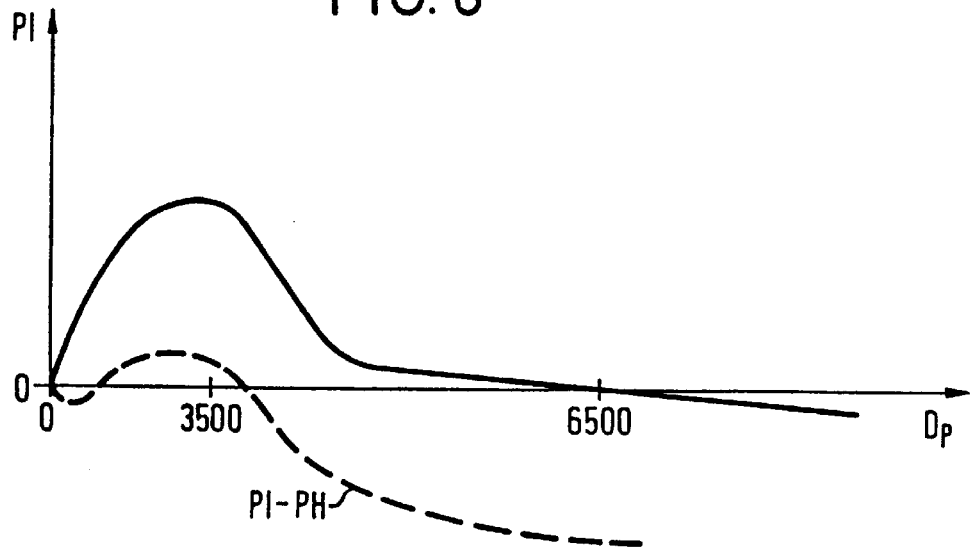
FIG. 8 is a graph showing the intermediate pressure PI and the pressure difference PI-PH for the pump as shown in FIG. 5 as a function of the pump speed.

When the ring-gear pump is operated at a low speed the flow of trapped oil QL through the connecting passage 53 corresponds to the displacement volume of the pockets 17.1 thru 17.3. With increasing speed the apparent flow impedance of the flow through the connecting passage 53 then rises, due to the opening times for the openings 50 and 51 become shorter and shorter. Correspondingly, the pressure PI in the pockets 17.1 thru 17.3 increases with a simultaneous drop in the flow of trapped oil QL through the connecting passage 53. These relationships apply, however, only up to the speed at which cavitation is still to occur in the suction kidney 11, i.e. in the pockets 13. In the cavitation region at a higher speed where accordingly the delivery characteristic (FIG. 3) has translated from a linearly increasing profile to a more or less horizontal profile, the pressures PI in the pockets drop to near atmospheric pressure. Since the suction pressure is maintained constant with speed, the QL curve now passes through the zero point and even becomes slightly negative. Oil flows to a minor extent from the pressure kidney 20 through the connecting passage 53 back to the pockets. At a very high speed, which practically never occurs, the negative flow of leakage oil QL from the pressure kidney 20 to the openings 50 and 51 would again approximate the zero line due to the rise in the apparent impedance of the flow. These relationships are depicted in FIG. 6. FIG. 7 shows the corresponding suction pressure PS in the suction kidney 11 as a function of the pump speed whilst FIG. 6 shows the intermediate pressure PI in the sealing web and the pressure difference PI-PH, PH being the pressure in the pressure kidney 20, as a function of pump speed for such a pump.

The bypass formed by the openings 50 and 51 and the connecting passage 53 may also be provided in addition to the overflow passages 128 provided with check valves 21 of the pump as shown in FIG. 4. Indeed, this represents a preferred embodiment, since due to such a bypass the flow through the overflow passages 128 may be additionally stabilized and it serving to counteract chatter of valves 21.

Figure 9:
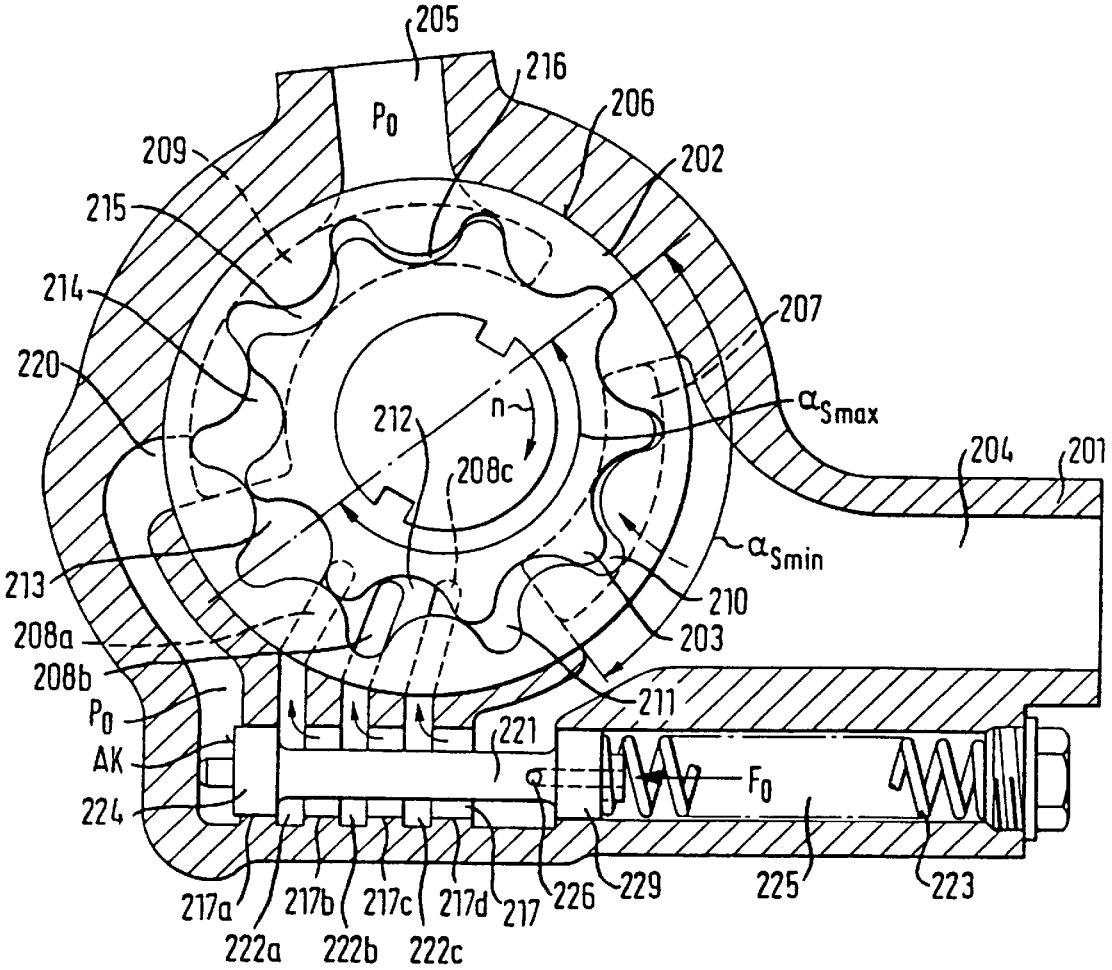
FIG. 9 is a cross-section view of an internal gear pump according to the invention in which the position of the valve means is represented in the starting condition of the pump.

In FIG. 9 a cross-sectional view of an embodiment of an internal gear pump according to the invention is shown. This pump has a housing 201 accommodating a gear chamber 206 with a ring gear 202. Mating with the ring gear 202 is a pinion 203 which has one tooth less than the ring gear 202. The pinion 203 forms together with the ring gear 202 a sequence of pockets 210, 211, 212, 213, 214, 215 and 216 each sealed off from the other by the mating of the gear teeth. An inlet passage 204 merges into an inlet port 207 formed as the inlet kidney, shown dashed. In addition, in the position shown in FIG. 9 the inlet passage 204 is connected through a drilled passageway 217 in the housing having the housing sleeves 217*a*, 217*b*, 217*c* and 217*d* to the supply passages 22*a*, 22*b* and 22*c* which exit in the inlet ports 208*a*, 208*b* and 208*c*.

At the outlet end the housing features an outlet passage 205 which is connected to the outlet kidney 209, also shown dashed, in the gear chamber 206. Furthermore, the outlet kidney 209 is connected at its end facing away from the outlet port 205 to a transit passage 220 which merges at the end of the drilled passageway 217 in the housing opposite the inlet passage 204 at housing sleeve 217*a* in this end. At the lower part of the housing 201 a valve means is provided. A spool 221 is located in this position of the valve means in the drilled passageway 217 of the housing, a header sleeve 224 of this spool 221 abutting by its front end against the housing in the transit passage 220 and sealing off by its side surfaces the drilled passageway 217 of the housing at the housing sleeve 217*a* from the fluid in the transit passage 220. At its rear end the spool 221 is guided in a spring chamber 225 by its rear sleeve 229 in which a spring 223 biases it in the direction of the sleeve point on the housing (in the left direction in FIG. 9) against the pressure in the transit passage 220 and against the sleeve of the header sleeve 224 at the housing 201 respectively. The spring chamber 225 is sealed off tight at its right-hand end by a plug bolt (not shown). A drilled passageway 226 in the spool 221 connects the surroundings thereof to the spring chamber 225 filled with working fluid, this resulting in a damping effect.

On the basis of FIG. 9 identifying all of these components the mode of operation of the internal gear pump according to the invention will now be described with the aid of the further Figures. Like components are identified by like reference numerals in all Figures. However, for a better survey FIGS. 10 to 13 no longer identify all components, but only those relevant to the explanation.

In the situation as shown in FIG. 9 the pinion 203 is turned in the direction as indicated by the arrow n. Fluid is drawn in via the inlet passage 204 and supplied, on the one hand, via the inlet kidney 207 to the pockets 210 and 211. On the other hand, working fluid is also supplied, however, via the drilled passageway 217 in the housing in the intermediate space between the spool 221 and said drilled passageway to the supply passages 22*a*, 22*b* and 22*c* and via these to the inlet ports 208*a*, 208*b* and 208*c* which furnish the pockets 212 and 213 with working fluid. In the situation shown in FIG. 9 the pump has proportional delivery, i.e. the delivery increases linearly with an increase in speed n. Since the header sleeve 224 seals of the drilled passageway 217 in the housing at the housing sleeve 217a from the fluid in the transit passage 220, only the pockets 214, 215 and 216 are pressurized. The spring force FO exerts a pressure on the spool 221 which is greater than or equal to the pressure Po against the surface of the header sleeve 224 identified AK.

In the following functional description it is assumed that at the outlet passage 205 one consumer is connected, the hydraulic resistance of which $$R = \frac{\Delta P}{\Delta Q}$$

is more or less constant.

Figure 10:
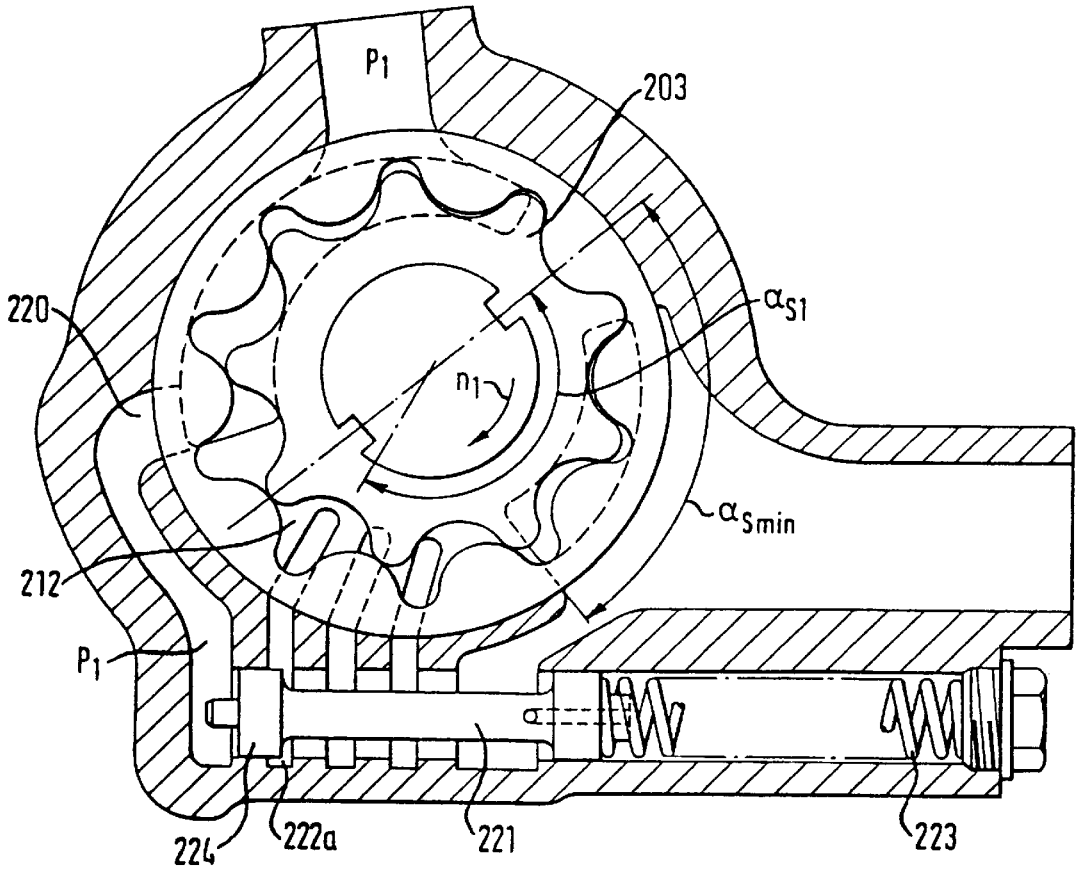
FIG. 10 is a cross-section view of an internal gear pump according to the invention in a speed situation higher than that shown in FIG. 9.

The control action commences as soon as the force exerted by the working fluid in the transit passage 220 against the header sleeve 224 exceeds that of the spring. In FIG. 10 the pinion 203 rotates at the speed n1 which is already higher than the limiting speed in the proportional range of the pump. In this case the pressure of the working fluid in the pressure region would increase linearly to a pressure P1, so that the spool 221 is moved to the right, resulting in the suction angle $\alpha_s$ being reduced from $\alpha_{smax}$ (see FIG. 9) to $\alpha_{s1}$ (see FIG. 10). The pressure $P_1$ required to be achieved linearly is unable to hold, however, it instead dropping to P1, thus also resulting in the delivery dropping linearly. At the increased speed n1 a new delivery and a new pressure P1 materialize, the latter being lower than $P_1$ but higher than P0. The adjustment of a pressure P1 which is higher than the pressure Po is also a result of design by the configuration of the valve means and the pump. If this pressure failed to be higher than Po namely, then the spool 221 would be forced back into its original position by the spring 223 and the process would begin all over again, due to the speed being higher than it was in the starting position. If the pressure $P_1$ in the pressure region has remained at the value $P_1$ the throttling effect of the piston 221 shifting to the right by the header sleeve 224 entering into the supply passage 22*a* on the filling of the pocket 212 would remain zero, this being the reason why the pressure $P_1$ needs to be between $P_o$ and $P_1$.

Figure 11:
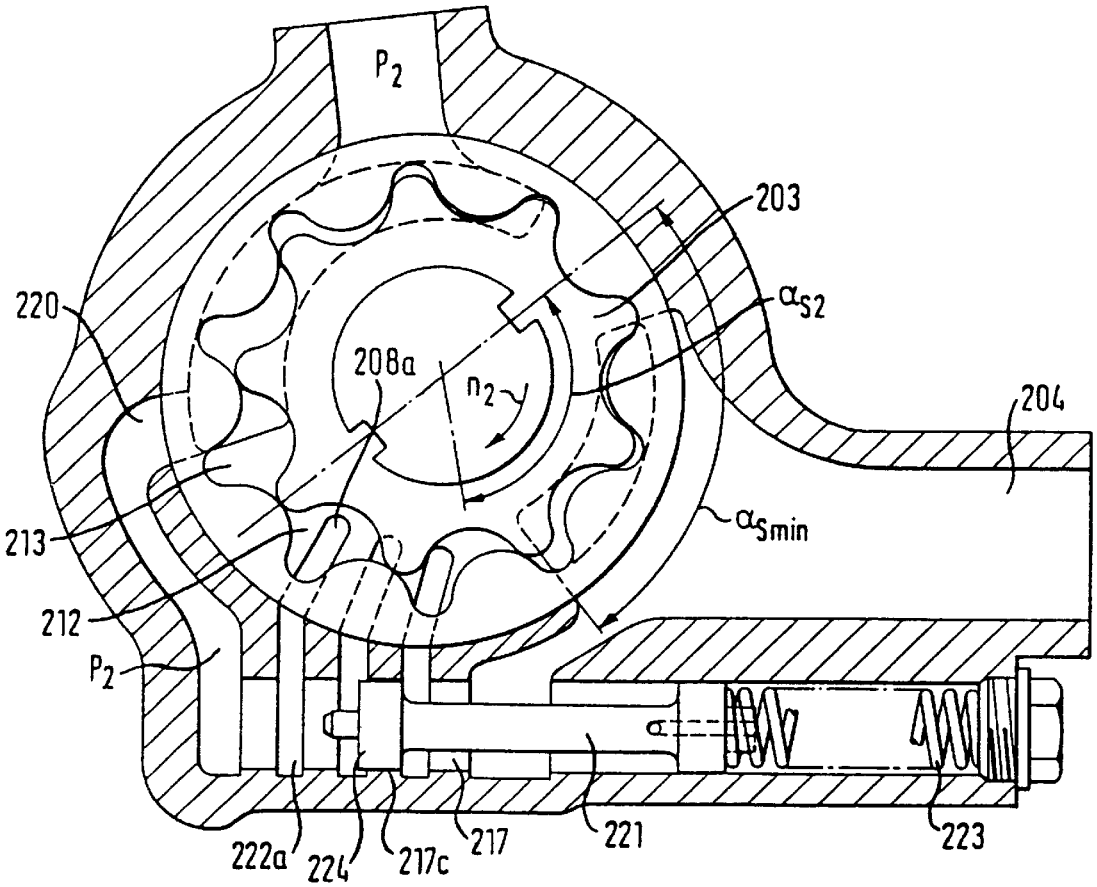
FIG. 11 is a cross-section view of an internal gear pump according to the invention in which the speed has increased to such an extent that the valve means has already released one pocket isolated from the supply by its inlet port for pressurizing from the pressure region.

From a consideration of FIG. 10 and FIG. 11 in combination it is evident what happens when the speed is further increased, in this case, the speed $n_2$ in FIG. 11. The process as described above for an increase in speed continues so that due to the increase in pressure the spool 221 is shifted further and further to the right until, as shown in FIG. 11 for example, a situation is reached in which the spool 221 seals of the drilled passageway 217 in the housing at the housing sleeve 217*a* by its header sleeve 224, so that the pocket identified here by 212 is supplied with suctioned working fluid not via the inlet passage 204, but via the transit passage 220 and the passageways 22*a* and 208*a* with pressurized working fluid. The working fluid in the pocket 212 is subjected together with pockets located downstream to the increased pressure $P_2$ so that no cavity is able to materialize therein and also, despite the increased space, no negative pressure is able to materialize. On the contrary, due to it being subjected to the pressure $P_2$ this pocket 212 generates a positive torque at the pinion 203, because its space expands under high pressure and works like a hydraulic motor. This inner differential control thus works with high efficiency. The pressurized working fluid at pressure $P_2$ is not decompressed to atmospheric pressure, it instead returning its potential energy as mechanical power to the drive shaft of the pump through the passageways with a certain loss in flow. The suction angle in this position is identified by $a_{S2}$.

Figure 12:
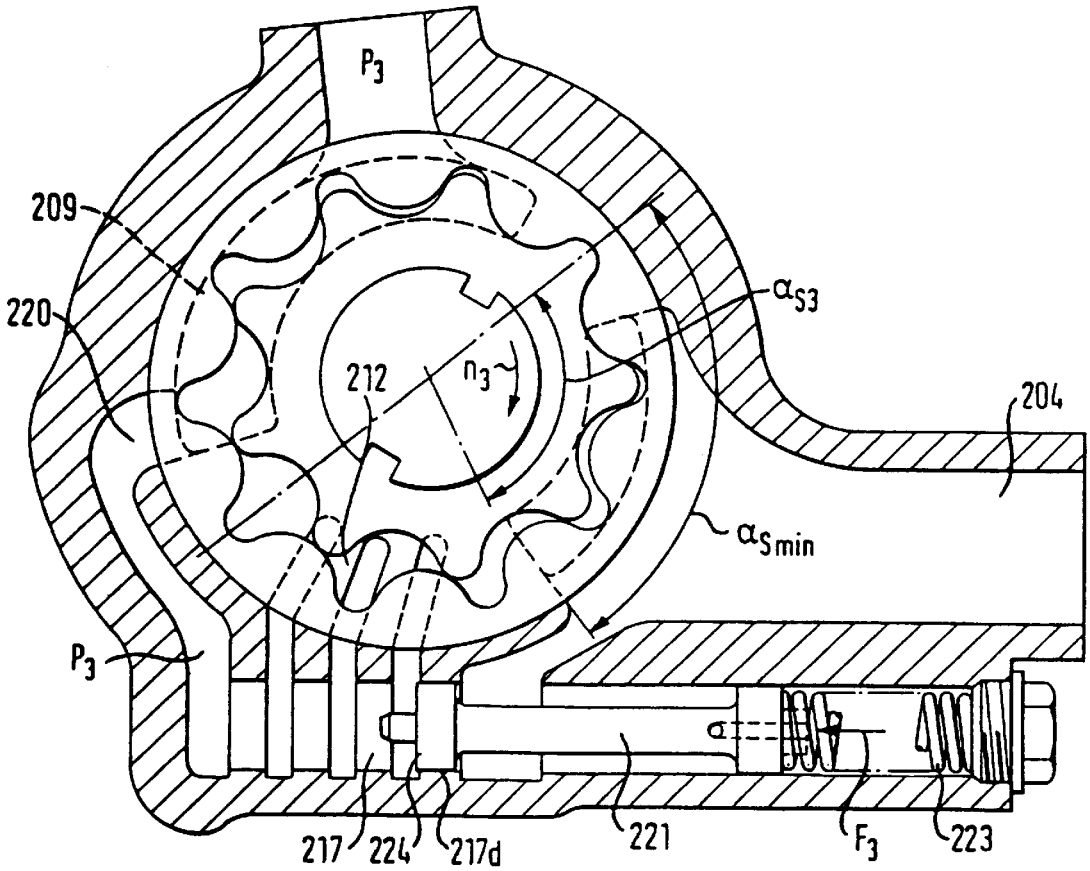
FIG. 12 is a cross-section view of an internal gear pump according to the invention in which the valve means has assumed a position in which all inlet ports and supply passages supply the pockets connected thereto with high-pressure working fluid.

In the situation shown in FIG. 12 the speed $n_3$ has now increased to the extent that the spool 221 is shifted so far to the right that the whole of the drilled passageway 217 in the housing is sealed off at housing sleeve 217*d* from the working fluid in the inlet passage 204. The pocket identified 212 and all pockets located downstream thereof now receive a supply of pressurized working fluid either via the outlet kidney 209 or via the transit passage 220 and the supply and inlet passages 222*a*, 222*b*, 208*a* und 208*b* intersecting the latter, the spring 223 being compressed full tilt. Half of the pockets used in the initial stage for suction are isolated from the inlet passage 204 and, at the same time, connected to the high pressure $P_3$, so that they act as a hydraulic motor, as already described above. Above all, the pump works over the full controlled range practically free of cavitation so that no noise results. In the speed range $n_0$ to $n_3$ no restrictor or any other throttle is needed in the inlet passage 204 due to the internal control as just described.

When the spool 221 is forced to the right until the spring is compressed full tilt, as in FIG. 12, no further internal control can take place. Any further increase in speed causes the delivery to further increase less steeply proportional to the speed, until cavities are formed in the remaining suction tooth pockets in the region of the short suction kidney 207.

The pump as described above is suitable mainly for supplying automatic transmissions having a pressure level of up to 25 bar or more. The stiffness of the spring 223 dictates the steepness of the delivery characteristic in the region of down control and needs to be adapted to the hydraulic impedance of the consumer.

Figure 13:
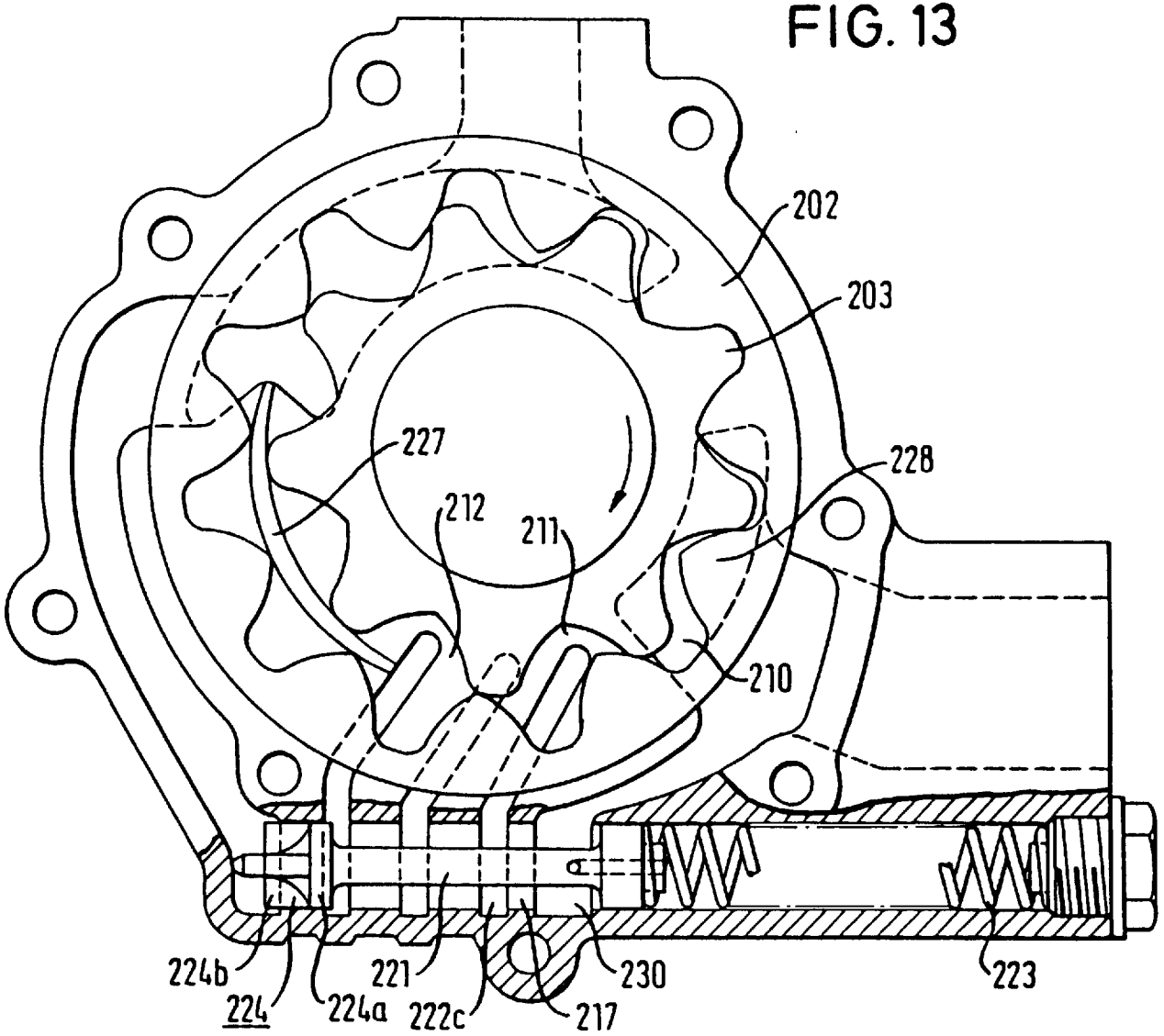
FIG. 13 shows a further embodiment of the internal gear pump according to the invention in which the the pinion has two teeth less than the teeth of the ring gear and a crescent-shaped filler fixed to the housing is provided at the point of unmeshing of the teeth.

FIG. 13 shows a further embodiment of the internal gear pump according to the invention highlighting two further aspects of the present invention. A first aspect relates in this context to configuring the pump with a pinion 203 which has two teeth less than the ring gear 202.

At the point of non-meshing of the teeth of the pinion 203 with the ring gear 202, a crescent shaped filler 227 is provided fixed to the housing. The teeth 228 of the ring gear 202 are configured sufficiently pointed to seal off the pockets from each other adequately for the mating in the suction range.

The operation of the internal gear pump illustrated in FIG. 13 and the function of the valve means correspond to that described with reference to FIGS. 9 thru 12.

Yet a further aspect of the invention, which is appreciated with reference to FIG. 13, relates to the safety valve effect of the valve means which operates as a bypass valve when the highest pressure in the pressure region of the header sleeve 224 has exceeded the last supply passage 222*c* to such an extent that the pressure region is short-circuited in the inlet passage 204 under decompression. In this arrangement the spring 223 is first permitted to compress full-tilt when a discharge flow cross-section is attained at this point adequate for this purpose. For the spool 221 to function as a safety valve the header sleeve 224 needs to be longer than the width of the recess 230. In FIG. 13 the header sleeve 224 is configured accordingly. If the header sleeve were too short, the piston would lose its guidance.

As is further evident from FIG. 13 the header sleeve 224 of the spool 221 in this case comprises a sleeve base 224*a* and an sleeve tag 224*b* connecting the latter lengthwise and having the same outer diameter. Guidance and sealing function of the spool 221 in the drilled passageway 217 in the housing at the sleeves thereof take place at the outer surfaces of the sleeve base 224*a* and the sleeve tag 224*b*. Although the sleeve base 224*a* itself is configured narrow, more particularly narrower than the width of the supply passages 22, good guidance and sealing may be assured by the recessed sleeve tag 224.

What is claimed is:

1. A valve train for an internal combustion engine a) having hydraulic actuator means for adjusting a valve control means as a function of engine speed and b) having a pump (100) driven by the engine for supplying the actuator means with working fluid, characterized in that c) said pump (100) is configured as a suction-controlled ring-gear pump having a sealing web extending over a plurality of pockets (17.1–17.3) and featuring a delivery characteristic as a function of speed which is adapted to the working fluid requirement of said actuator means.

2. The valve train as set forth in claim 1, characterized in that said valve control means are camshafts, the phasing of which is variable for controlling the overlap timing of the intake and exhaust valves.

3. The valve train as set forth in claim 1 characterized in that said pump (100) supplies an actuator means with working fluid for altering a valve stroke.

4. The valve train as set forth in claim 1, characterized in that said pump (100) supplies an actuator means with working fluid with which a cylinder of the engine may be shut on and off.

5. The valve train as set forth in claim 1, characterized in that said pump (100) supplies the engine with lubricating oil and the lubricating oil also serves as the working oil for said hydraulic actuator means.

6. The valve train as set forth in claim 1, characterized in that a throttle (14; 43) on the suction of said pump (100) is variable to enable the delivery characteristic of said pump to be adapted to the requirement of the valve train.

7. The valve train as set forth in claim 6, characterized in that said throttle (14, 43) is configured in a staged manner, particularly two-staged.

8. The valve train as set forth in claim 1, characterized by a pump comprising a housing (1), an internally toothed annulus rotatively arranged in a gear chamber of said housing (1), a pinion (4) arranged to mesh in said annulus (2) having one tooth less than the latter, the teeth of which form together with the teeth of said annulus (2) expanding (13) and contracting (17) fluid pockets which are in sequence and sealed off from each other and are each connected to the neighbouring pockets by overflow passages (128) provided in said annulus (2) and/or said pinion (4), check valves (21) in said overflow passages (128) for the supply and discharge of the working oil which merge in said gear chamber on both sides of the point (7) of deepest mesh, one end of a port (2) of said outlet port (19) sleeve from said point (7) of deepest mesh being located so near to said point (7) of deepest mesh that between it and the point on the circumference at which said pockets begin to contract a plurality of said contracting fluid pockets (17.1–17.3) is always located.

9. The valve train as set forth in claim 8, characterized in that at least one further port (35) connecting said outlet passage (19) is disposed upstream away from the port (20) of said outlet passage (19) in the circumferential direction of said pump which is connected via a conductor (36) to said outlet passage (19), the flow through said conductor (36) is controllable, particularly blockable by means of a throttle member (37), and a control device for said throttle (14, 43) at the suction end and said throttle member (37) is provided.

10. The valve train as set forth in claim 9, characterized in that said control device controls said suction-end throttle member (37) adapted to the working fluid requirement of said actuator means.

11. The valve train as set forth in claim 8, characterized in that in the region of the contracting fluid pockets (17.1–17.3) in one wall of said gear chamber circumferentially spaced away from said port (20) of said outlet passage (19) at least one opening (50, 51) covered alternately by said pockets (17.1–17.3) and the teeth bordering the latter is located, said opening (50, 51) is connected via a connecting passage (53) to said outlet passage (19), and that said opening (50, 51) is covered on every overflow by one tooth fully or at least to a major extent.

12. The valve train as set forth in claim 11, characterized in that a plurality of openings (50, 51) is connected to said outlet passage (19) via said joint connecting passage (53).

13. The valve train as set forth in claim 11, characterized in that said connecting passage (53) is provided with a passageway (54, 55) branching off radially from said opening (50, 51).

14. The valve train as set forth claim 11, characterized in that the openings of said plurality of openings (50, 51) circumferentially arranged in sequence are spaced away from each other by roughly half a tooth pitch and the coverage of the opening (50, 51) circumferentially is approximately the same as the thickness of the teeth covering them to the radial height of the opening (50, 51).

15. The valve train as set forth claim 11, characterized in that said openings (50, 51) extend radially to roughly ⅕th to roughly ⅓rd of the height of the teeth covering them.

16. The valve train as set forth in claim 2, characterized in that said pump (100) supplies an actuator means with working fluid for altering a valve stroke.

17. The valve train as set forth in claim 2 characterized in that said pump (100) supplies an actuator means with working fluid with which a cylinder of the engine may be shut on and off.

18. The valve train as set forth in claim 2, characterized in that said pump (100) supplies the engine with lubricating oil and the lubricating oil also serves as the working oil for said hydraulic actuator means.

19. The valve train as set forth in claim 2, characterized in that a throttle (14, 43) on the suction of said pump (100) is variable to enable the delivery characteristic of said pump to be adapted to the requirement of the valve train.

20. The valve train as set forth in claim 3, characterized in that and pump (100) supplies an actuator means with working fluid with which a cylinder of the engine may be shut on and off.

* * * * *

UNITED STATES PATENT AND TRADE MARK OFFICE

CERTIFICATE OF CORRECTION

PATENT NO. : 5,842,449
DATED : December 1, 1998
INVENTOR(S) : Siegfried A. Eisenmann It is certified that error appears in the above-identified patent and that said Letters Patent is hereby corrected as shown below:

On the cover page item57, line 3 after "device" insert -- as -- .

On the cover page item57, line 6, delete "ending" and substitute therefor -- extending --.

Signed and Sealed this

Twenty-fifth Day of May, 1999

*Attest:*

Q. TODD DICKINSON

*Attesting Officer*

*Acting Commissioner of Patents and Trademarks*